US006286668B1

(12) United States Patent
Moses

(10) Patent No.: US 6,286,668 B1
(45) Date of Patent: Sep. 11, 2001

(54) FLAT ARTICLE CARRYING CASE AND STORAGE SYSTEM UTILIZING THE SAME

(76) Inventor: Allen Moses, 682 E. 7th St., Brooklyn, NY (US) 11218

( * ) Notice: Subject to any disclaimer, the term of this patent is extended or adjusted under 35 U.S.C. 154(b) by 0 days.

(21) Appl. No.: 09/315,078

(22) Filed: May 19, 1999

Related U.S. Application Data

(60) Provisional application No. 60/085,991, filed on May 19, 1998.

(51) Int. Cl.[7] ..... B65D 85/00

(52) U.S. Cl. ..... 206/215; 206/451; 211/71.01; 190/127

(58) Field of Search ..... 206/451, 455, 206/215, 425, 224; 248/95, 97; 211/71.01, 204; 190/127, 122; 150/130, 127; 220/4.01, 480, 481

(56) References Cited

U.S. PATENT DOCUMENTS

| | | | | |
|---|---|---|---|---|
| 1,768,796 | * | 6/1930 | Trager | 190/130 |
| 2,086,895 | * | 7/1937 | Cart | 190/127 |
| 2,159,995 | * | 5/1939 | Lifton | 150/130 |
| 4,529,069 | * | 7/1985 | March | 190/114 |
| 4,623,111 | * | 11/1986 | Prader | 248/97 |
| 4,913,283 | * | 4/1990 | Stuhn | 206/224 |
| 5,160,001 | * | 11/1992 | Marceau | 190/127 |
| 5,566,798 | * | 10/1996 | Tsai | 190/127 |
| 5,931,373 | * | 8/1999 | Peleman | 229/122.24 |

* cited by examiner

*Primary Examiner*—Shian Luong
(74) *Attorney, Agent, or Firm*—Lackenbach Siegel Marzullo Aronson & Greenspan, P.C.

(57) ABSTRACT

A flat article carrying case includes corrugated sheet material which substantially wraps about the entire case with the exception of the lateral sides of the case. A handle is attached to the front side of the carrying case. Two frame members, forming the lateral sides of the carrying case, are provided for providing stiffness and rigidity to the case, when covered with corrugated sheet material which is flexible along a direction parallel to the frame members but substantially rigid or stiff in the transverse direction extending between the frame members. However, it will be evident that different covering sheet materials may be used, in which case different numbers of frame members may be needed to provide requisite stiffness or rigidity to the resulting carrying case. VELCRO or other suitable detachable fastener is used for selectively attaching the sheet material forming the top and bottom sides to the frame members to permit selective opening of the case to provide access to the interior thereof and to permit insertion and removal of flat articles to or from the case. A storage system utilizing such carrying cases includes vertical support members which are maintained substantially vertically by a base or the like is provided with shelving runners on which one or more pairs of shelf brackets may be mounted configured to be received within the rear sides of the carrying cases to provide a permanent storage for the carrying cases and the relative flat large articles contained therein.

18 Claims, 7 Drawing Sheets

10c
10f
28
14
18
t
35
12
36a
36b
38
18
38

14e
10e
14
10f
14
18a
18
16
14c
14b
14d
14a
14e
14f
14g 26b
26a
26

24
22
24
20
T
m
20b
20

FLAT ARTICLE CARRYING CASE AND STORAGE SYSTEM UTILIZING THE SAME

This application claims the benefit of Provisional No. 60/085,991 filed May. 19, 1998.

BACKGROUND OF THE INVENTION

1. Field of the Invention

This invention generally relates to carrying cases and storage systems, and, more specifically, to a flat article carrying case or portfolio and storage system utilizing the same.

2. Description of the Prior Art

Certain large flat articles, such as engineering drawings, prints, drawings and paintings prepared by artists, large photographs, large advertising layouts and the like, have generally not been simple to transport and/or store. Unless these articles were rolled up and placed inside cardboard or metallic tubes, any carrying case designed to carry such flat articles or materials were necessarily much thinner than they were wide or deep. As a result, portfolios and the like used for carrying such materials tended to be flexible. While such flexibility has not presented a serious problem in terms of transporting the articles, excessive bending of the carrying case could impart creases to the materials being carried and possibly damage the same, particularly if the articles being carried are not themselves flexible, such as mat board, canvases and the like.

Currently known portfolios are simply larger versions of smaller briefcases. However, exhibiting large sized flat articles or removing same from a case for display is typically inconvenient or difficult. Since the only way to view or to show the article carried in such a case is by removing the article from the case such large flat articles are sometimes difficult to handle and removal or repeated handling can result in damage. Most existing portfolios do not permit the display or partial display of a flat article, such as a drawing, without removing the drawing from the portfolio.

For the same reasons that large flat articles, of the type aforementioned, are difficult to transport and display, they are equally difficult to store. Generally, the portfolios used for carrying the articles are not used for storing them. Accordingly, such articles, as unwieldy as they may be to handle, must typically be removed from the portfolios and placed in an appropriate storage device, such as a large cabinet of drawers, each of the drawers of which must be sufficiently large to accept or receive the articles in a flat condition. Such cabinets, typically made of wood or metal, can be extremely costly. Of course, whenever the flat article needs to be transported it must be removed from the drawer into which it has been stored and transferred to the portfolio. Such movement of large articles between the storage system and the portfolio used for carrying the same, and vice versa, is generally inconvenient and time consuming, and may result in damage to the flat articles.

Flat portfolios or cases for storing and transporting flat stock materials, such as drawings or paintings, have been used for a long time by artists and draftsmen. U.S. Pat. No. 931,853 is one example of a flat case that can be used for this purpose.

Many flat cases frequently used by artists include handles to allow these cases to be carried about. Examples of such flat cases are disclosed in U.S. Pat. Nos. 1,175,070 to Maxwell, 4,061,224 to Fuhri and 4,852,725 to Folsom.

The portable easel device disclosed in U.S. Pat. No. 4,372,630 includes a carrying case with support legs for supporting the easel in the ground. A form of storage system or structure for detachably receiving at least one retaining board is disclosed in U.S. Pat. No. 4,793,508 to Thompson. Here the entire case or storage system is itself portable. When such case or stage system is on the ground, individual panels may be selectively removed, as best shown in FIG. 3A.

Also known, also no patents are herein cited, are relatively wide file cabinets which have relatively thin drawers for storing flat drawings, such as engineering drawings. Such drawers, however, are normally not intended to be removed since they are very heavy and not really portable.

SUMMARY OF THE INVENTION

Accordingly, it is an object of the present invention to provide a flat article carrying case which does not have the disadvantages inherent in prior carrying cases.

It is another object of the present invention to provide a flat article carrying case which is simple in construction and economical to manufacture.

It is still another object of the present invention to provide a flat article carrying case which is convenient and easy to use.

It is yet another object of the present invention to provide a flat article carrying case of the type aforementioned which can be used both for transporting flat articles, such as engineering drawings, paintings, drawings, advertising layouts, etc.; as well as display or at least partially display such articles without being removed from the carrying case.

It is a further object of the present invention to provide a flat article carrying case as in the previous objects which is made of lightweight and sturdy materials which protects the flat articles carried therein both from bending as well as from the elements.

It is still a further object of the present invention to provide a storage system which can selectively store one or more of the carrying cases suggested in the previous objects so that the flat articles can be both transported and stored within the carrying cases, which become part of the storage system.

In order to a achieve the above objects, as well as others which will become evident hereinafter, a flat article carrying case in accordance with the present invention has a top and bottom, front and rear, and lateral s ides. Said top and bottom sides have width dimensions between said lateral sides and depth dimensions between said front and rear sides, which are substantial greater than the dimensions of said front, rear and lateral sides, between said top and bottom sides. At least said top side and said bottom sides are formed of a relatively thin, lightweight sheet material. A handle is provided on at least one of said front, rear or lateral sides for carrying the case. At least two elongate substantially parallel and rigid frame members are arranged along at least two of said front, rear and lateral sides of the case for stiffening the case and preventing twisting and warping of said top and bottom sides. Attachment means is providing for selectively attaching said sheet material forming said top and bottom sides to said frame members to permit opening of the case and provide access to the interior thereof to insert or remove flat article to and from the case.

A storage system for storing at least one carrying case of the type aforementioned includes support means which includes at least two spaced substantially horizontal brackets arranged in a common horizontal plane. At least one flat carrying case is provided, said rear side of such carrying case is provided with openings, aligned with said frame members, configured to receive said brackets to engage said frame members to thereby support the case on said brackets.

BRIEF DESCRIPTION OF THE DRAWINGS

The features and advantages of the present invention will become apparent from the following description of the invention, taken together with the accompanying drawings, in which.

DESCRIPTION OF THE PREFERRED EMBODIMENTS

Figure 1:
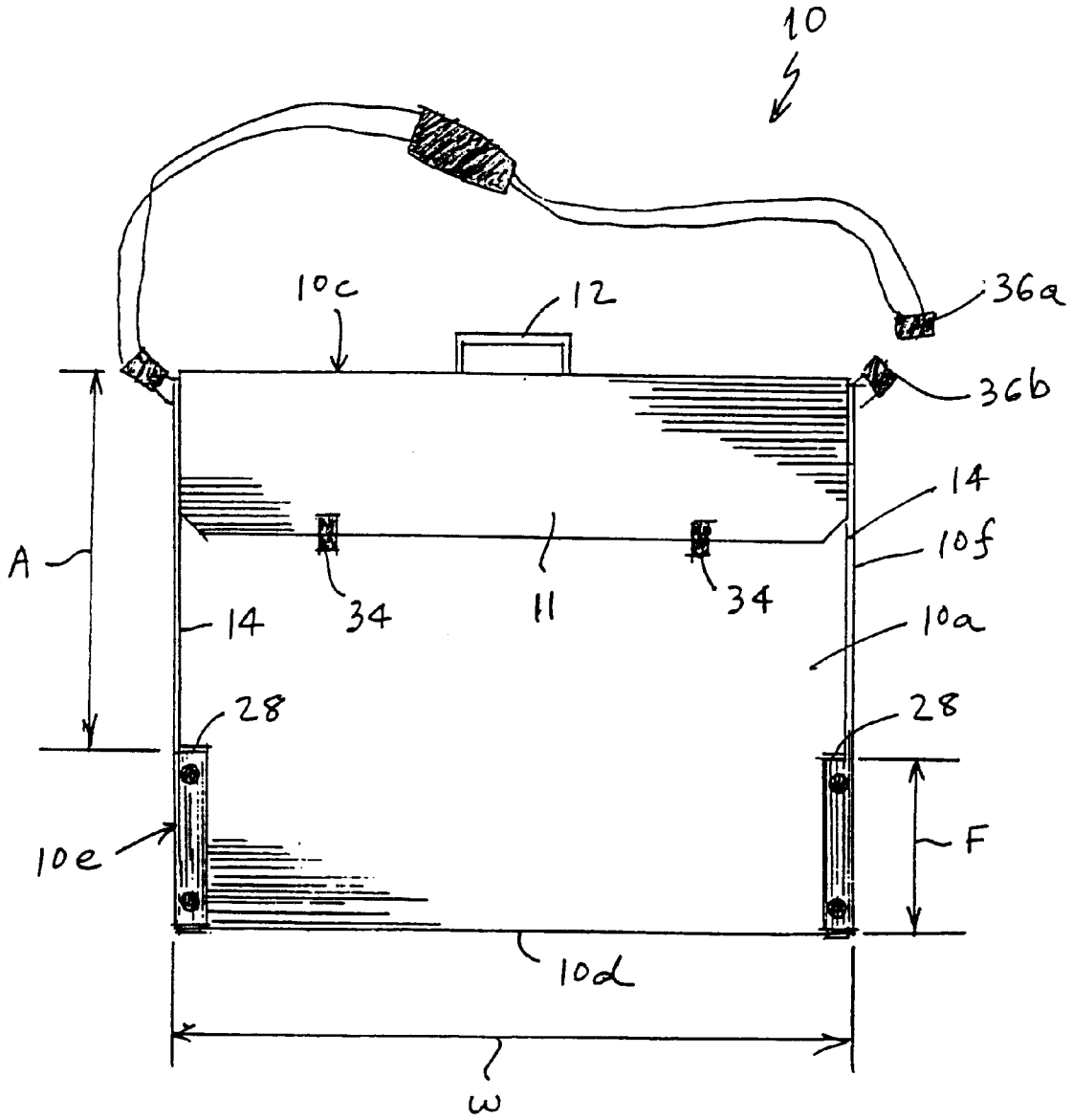
FIG. 1 is a top plan view of a flat article carrying case in accordance with the present invention, shown in its fully closed condition, with a detachable carrying strap disconnected at one end thereof.
Figures 2, 3, 5, 6, 7, 8:
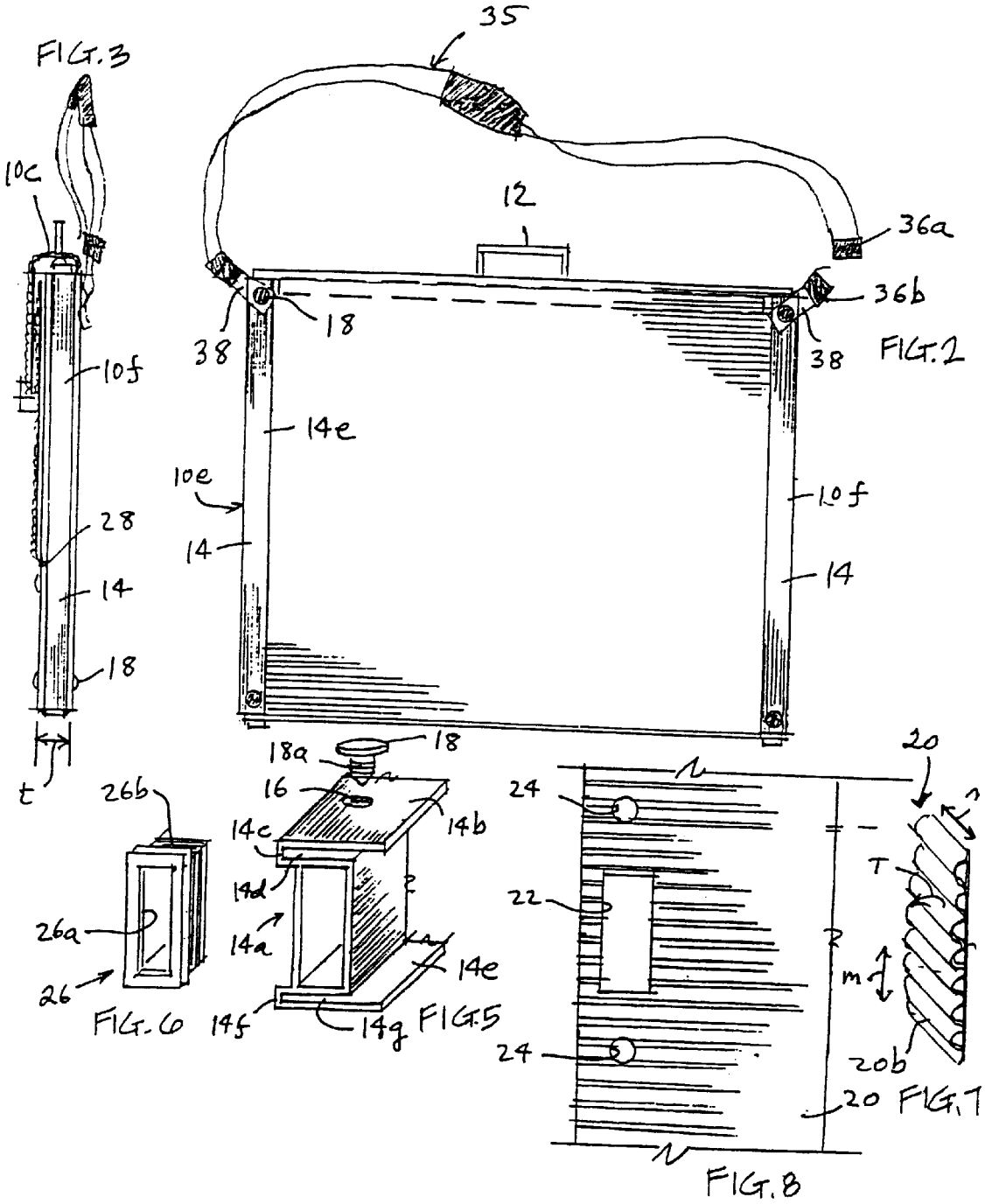
FIG. 2 is a rear elevational view of the carrying case shown in FIG. 1, showing the manner in which the detachable carrying strap is secured to the carrying case.
FIG. 3 is a side elevational view of the carrying case shown in FIGS. 1 and 2.
FIG. 5 is a perspective view of an end of an extrusion that may be used to construct the carrying case shown in FIGS. 1–4, showing the cross section of the extrusion and a hole in one of the walls of the extrusion suitable for receiving a plastic rivet for assembling the briefcase.
FIG. 6 is a perspective view of a cap plug dimensioned to be received within the rectangular opening or cavity at an end of the extrusion shown in FIG. 5 for securing the covering sheet material to the extrusion, for receiving supporting brackets which form part of a storage system and for serving as legs on which the carrying case may be supported when placed on a surface.
FIG. 7 is a perspective view of section of a corrugated material of a type which may be used with the present invention as a covering sheet material for the carrying case.
FIG. 8 illustrates a section of the corrugated covering sheet material which wraps around the rear side of the carrying case, showing the rectangular opening which is dimensioned to register with the rectangular opening in the extrusion shown in FIG. 5 and two holes which are arranged to register with the holes in the upper and lower walls of the extrusion so that they may be secured to the extrusion by means of the plastic rivets.

Referring now specifically to the Figs., in which identical or similar parts are designated by the same reference numerals throughout, and first referring to FIGS. 1–3, the flat article carrying case in accordance with the present invention is generally designated by the reference numeral 10.

The carrying case 10 has top and bottom sides 10*a*, 10*b*, front and rear sides 10*c*, 10*d* and lateral sides 10*e*, 10*f*. Being essentially a portfolio type carrying case for transporting and storing large flat articles such as engineering drawings, prints, paintings, sketches, large photographs and posters, advertising layouts and the like, the top and bottom sides 10*a*, 10*b* have width dimensions "w" between the lateral sides 10*e*, 10*f* and depth dimensions "d" between the front and rear sides 10*c*, 10*d* which are substantially greater than the dimensions "t" (FIG. 3) of the front, rear and lateral sides 10*c*, 10*d*, 10*e* and 10*f* extending between the top and bottom sides 10*a*, 10*b*. Stated otherwise, the dimensions "d" and "w" are substantially greater than the height or thickness "t" of the carrying case. As such, the carrying case would normally be susceptible to bending, twisting and/or warping.

Since it is intended that the case 10 be used for carrying or transporting flat articles, it is important that the case be light in weight, even though it may be relatively large in terms of its width "w" and depth "d". It is important, therefore, that at least the top and bottom sides 10*a*, 10*b* be formed of a relatively thin lightweight sheet material. As will become evident from the description that follows, the top and bottom sides 10*a*, 10*b* may be formed of individual panels. However, in accordance with the presently preferred embodiment, these panels are formed of one continuous sheet which extends about the perimeters of the lateral sides 10*e*, 10*f* and, therefore, also covers the front and rear sides 10*c*, 10*d* of the case.

A handle 12 is shown provided on the front side 10*c*, although it will be evident that the handle may be provided on any convenient side of the carrying case, such as the front, rear or lateral sides 10*c*, 10*d*, 10*e* and/or 10*f*.

According to one feature of the present invention, at least two rigid frame members 14 are provided for stiffening or rigidifying the carrying case and prevent the bending, twisting and/or warping thereof The number of frame members will be a function of the nature of the covering sheet material. Where the sheet material is flexible along all directions, four frame members may need to be provided along the front, rear and lateral sides 10*c*, 10*d*, 10*e* and 10*f*. However, in accordance with the presently preferred invention, in which the covering sheet material is flexible along one direction and relatively rigid in a normal orthogonal direction, only two frame members need to be provided. In the presently preferred embodiment, therefore, only two rigid frame members 14 are provided which form the lateral sides 10*e*, 10*f* of the carrying case. The covering sheet material must, therefore, inherently provide rigidity or stiffness in the direction normal to the lateral sides 10*e*, 10*f*. An example of such material will be discussed more fully in connection with FIGS. 7 and 8.

Referring to FIG. 5, a cross section of a presently preferred extrusion 14 is illustrated. The extrusion 14 essentially consists of a rectangular tube 14*a* which defines a rectangular opening 14*a*'. An upper wall 14*b* is spaced from the tube 14*a*, as shown, by means of a connecting rib 14*c* to form or define a relatively flat elongate space 14*d* between the upper wall 14*b* and the rectangular tube 14*a*. Similarly, a lower wall 14*e* is spaced from the rectangular tube 14*a* by means of a rib 14*f* to form an elongate flat space 14*g*. Each of the upper and lower walls 14*b*, 14*e* may be provided, as required, with holes 16 dimensioned to frictionally receive and engage a plastic rivet 18 which is provided with ribs 18*a* as shown for engaging the respective walls when inserted into the holes.

Referring to FIG. 7, one example of a suitable covering sheet material 20 is illustrated which is in the form of corrugated sheet material. The sheet material 20 is formed of a relatively thin, flat skin of material 20*a* to which there is attached a ribbed or undulating sheet of material 20*b*. Such materials are commonly referred to as "hollow core single face" corrugated materials and are sold, for example, under the brand name DIVERSI-BOARD™ by Diversi-Plast Products Co. of Minneapolis, Minn. Such materials are typically made of plastic, and particularly polyethylene. However, it will be clear that the present invention is not limited to any specific covering sheet material nor any specific plastic used for such material. With a material of the type shown in FIG. 7, the corrugated sheet material may be readily folded or bent along the direction of corrugations "m" so as to maintain the corrugations 20*b* exteriorly of any reduced folded angle. It will be clear, however, that the corrugations provide stiffening along the direction "n" parallel to the corrugations. Therefore, if bending is to take place about point "p", the material 20 can be readily folded along the direction of arrows S but not along the direction of arrows T. However, inherently, the material can only be readily bent along lines such as at lines "p", where the ribbed or undulating sheet 20*b* is attached to the flat sheet or face 20*a*.

In FIG. 8, a section of the corrugated sheet material 20 is shown provided with a rectangular opening 22 and two spaced holes 24. The portion of the corrugated sheet material sheet material shown in FIG. 8 is that portion which overlaps or folds about the rear end or side 10*d* of the rigid frame members 14. The rectangular opening 22 is dimensioned to generally correspond to the opening 14*a*' of the rectangular tube portion 14*a*, while the holes 24 are arranged to register with the holes 16 in the upper and lower walls 14*b*, 14*e*. Once so aligned, plastic rivets 18 can be inserted through the sheet material 20 and the holes 16 to secure the sheet material to the frame member at the rear side 10*d* of the carrying case. Once so attached, a cap plug 26 (FIG. 6) may be used, which has a ribbed generally rectangular extension 26*b* dimensioned to be received through both the rectangular opening 22 and the rectangular opening 14*a*' in interference or friction engagement. By projecting beyond the covering sheet material 20, the cap plug 26 serves a number of functions. First, it helps to secure the ribbed covering sheet material to the frame members 14. Additionally, by selecting the size and configuration of the slot 26*a* the cap plug may also be used as a receptacle for a shelf bracket, as to be described in connection with FIGS. 11, 12. Additionally, the cap plug 26 also serves as a foot or leg for the carrying case on which the case may be rested when placed on a floor or other surface.

Figure 9:
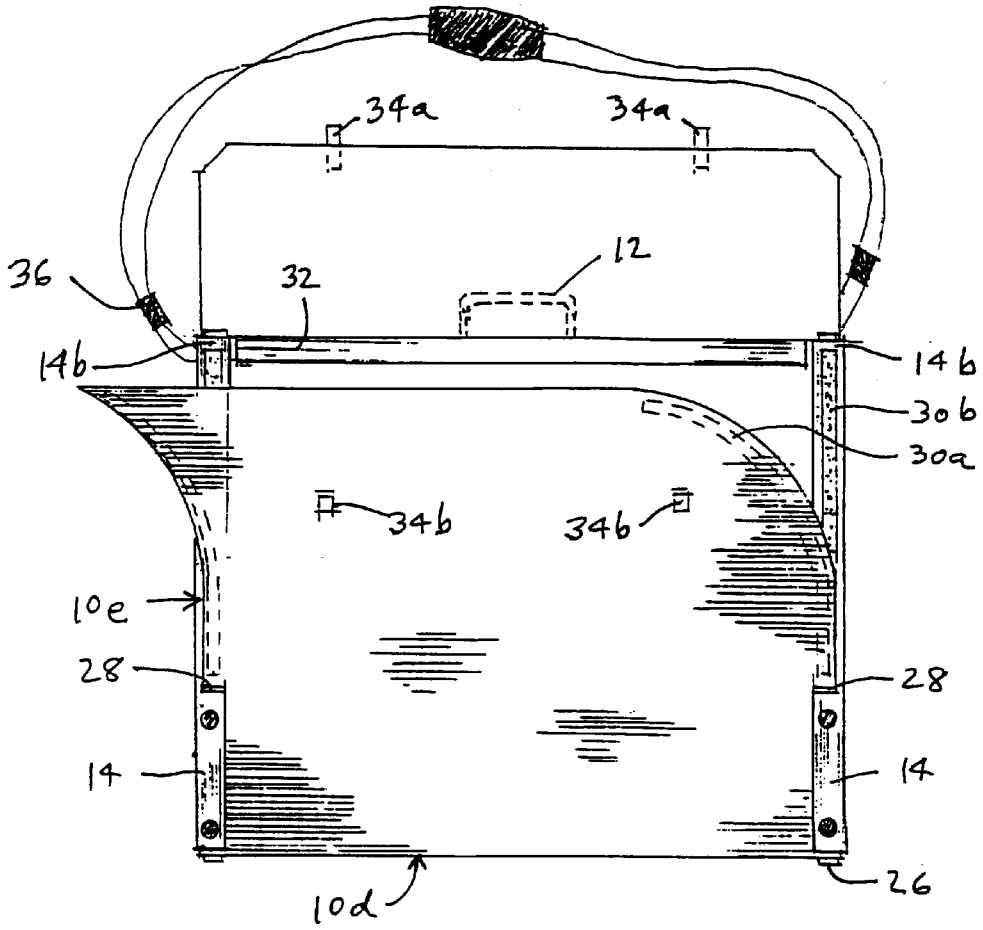
FIG. 9 is a view similar to FIG. 1, shown with the overlapping flap opened and the top panel or sheet of material forming the top side separated from the rigid frame members forming the lateral sides of the carrying case.
Figure 4:
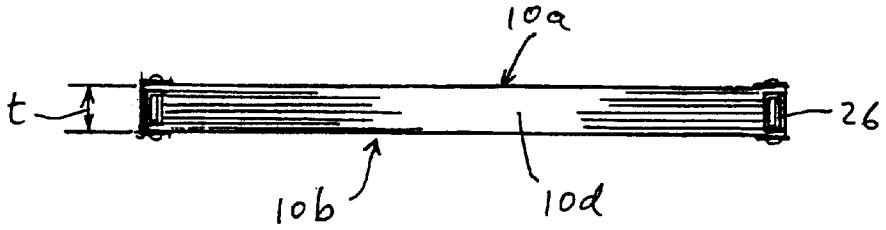
FIG. 4 is a rear elevational view of the carrying case shown in FIGS. 1–3.

Referring to FIGS. 1, 3 and 9, it will be noted that the extrusions 14 are perfectly provided with aligned slits 28 in the upper walls 14*b* of the respective extrusions. While the thickness of the corrugated sheet material 20 generally corresponds to the thickness of the flat spaces 14*d*, 14*g* formed in the extrusions for receiving the lateral edges of the covering sheet material, it will be evident that if the entire extent of the covering sheet material, including the top and bottom sides, are maintained within such spaces 14*d*, 14*g* the top and bottom sides of the covering sheet materials will be captured and prevented from moving relative to the frame members. This will prevent ready access to the carrying case as well as ready insertion, removal and/or display of flat works within the carrying case. By placing the slits 28 closer to the rear side 10*d* than to the front side 10*c*, the top side 10*c*, as viewed in FIGS. 1, 3 and 9, remains captured only over a relatively small fixed portion F (FIG. 1), while maintaining the top side 10*a* over the remaining extent A exteriorly of or above the upper wall 14*b* and, therefore, movable in relation to the wall of the support member.

Figure 10:
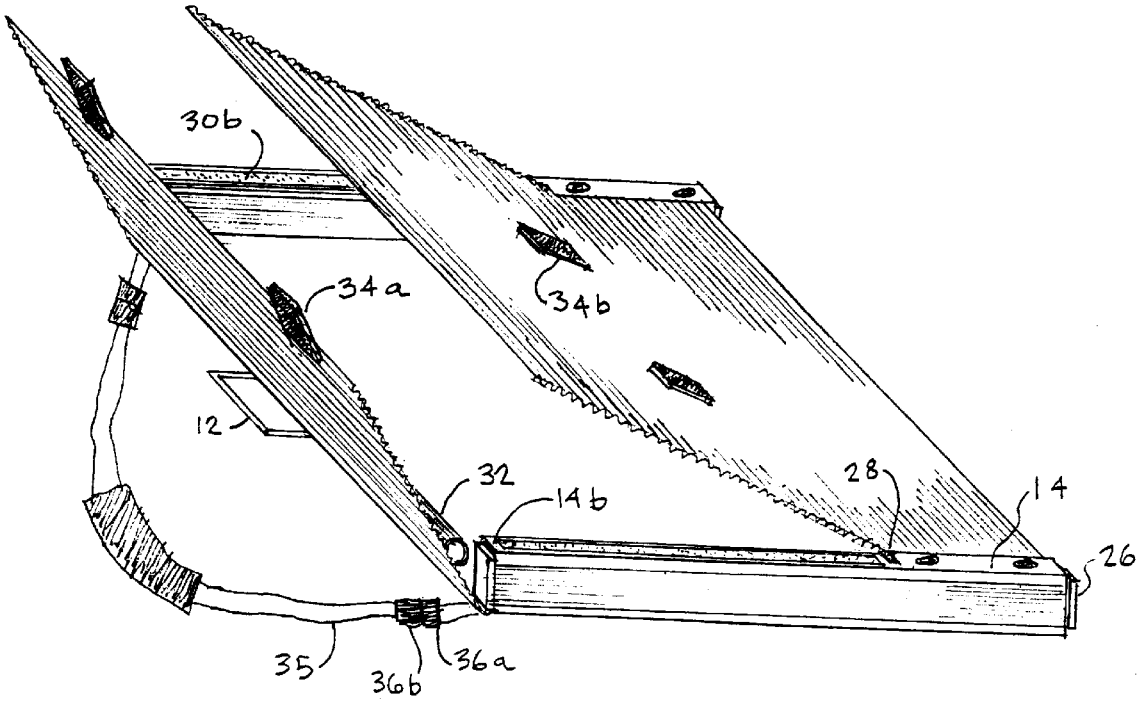
FIG. 10 is a perspective view of the carrying case partially opened to provide access to the interior of the carrying case for insertion, removal or display of a flat object within the case.

While any suitable attachment means may be used, in the present preferred embodiment, "hook" and "loop" tape material 30*a*, 30*b*, of the type sold under the trademark VELCRO®, may be used on the upper walls 14*b* of the extrusions or frame members 14 as well as on the inside surface of the top side or panel 10*a* so that the top side panel may be selectively attached to the frame members or separated from them. It will be clear, particularly from FIG. 9, that the top side panel 10*a* may be folded back up to the slits 28 through which the covering sheet material passes as it moves from the flat spaces 14*d*, 14*g* in the region F to a position above the upper wall 14*b*, in the region "A". FIG. 10 shows an alternative manner of achieving the same or similar result. With a conventional rectangular extrusion, not provided with the additional upper and lower walls 14*b*, 14*g*, the covering sheet material may be wrapped exteriorly of the frame members about the entire peripheries thereof, suitable plastic rivets 18 being used to control the extent to which the top side panels may be opened or separated from the respective frame members along the region F. While both arrangements may serve equally well for most purposes, the more costly extrusion 14 shown in FIG. 5 is preferred since it provides a more aesthetically pleasing finished product.

In order to strengthen the connection between the handle 12 and the front side 10*c* of the corrugated sheet material, there is preferably provided a tube 32 on the other side of the sheet material to which the handle 12 may be secured. A better connection can generally be achieved to the tube 32, which may be a PVC tube, which can then serve as a support and stiffening member that distributes the load applied on the handle 12 across the entire width of the carrying case. Although not critical, the carrying case 10 is preferably provided with clips 34 (FIG. 1) which may be plastic clips consisting of male members 34*a* on the top die 10*a* and female members 34*b* on the flap 11 which overlaps the top side panel. In FIG. 1 the clips 34 are fastened to each other, this preventing the separation or opening of that portion of the top side panel 10*a* which is secured to the frame members 14 by means of the hook and loop fasteners 30*a*, 30*b*. Also, referring to FIG. 3, an adjustable strap 35 is preferably provided which includes clips 36 at each end secured to strap extensions 38 permanently attached to the frame members 14 by means of rivets 18. As with the clips 34, the clips 36 likewise include male and female members 36*a*, 36*b* which can be snapped into each other or separated in a conventional way.

Referring to FIGS. 9 and 10, the opening of the clips 34 allows the flap 11 which overlaps the top side panel 10*a* to be opened, thus enabling the top side panel to be folded back over the accessible region A (FIG. 1) by separating the lateral edges of such panel from the associated frame members 14 against the action of the hook and loop fasteners. By allowing the top side panel 10*a* to be folded back sufficiently, this facilitates insertion or removal of a relatively flat large article or the display thereof while maintained within the carrying case.

Figure 11:
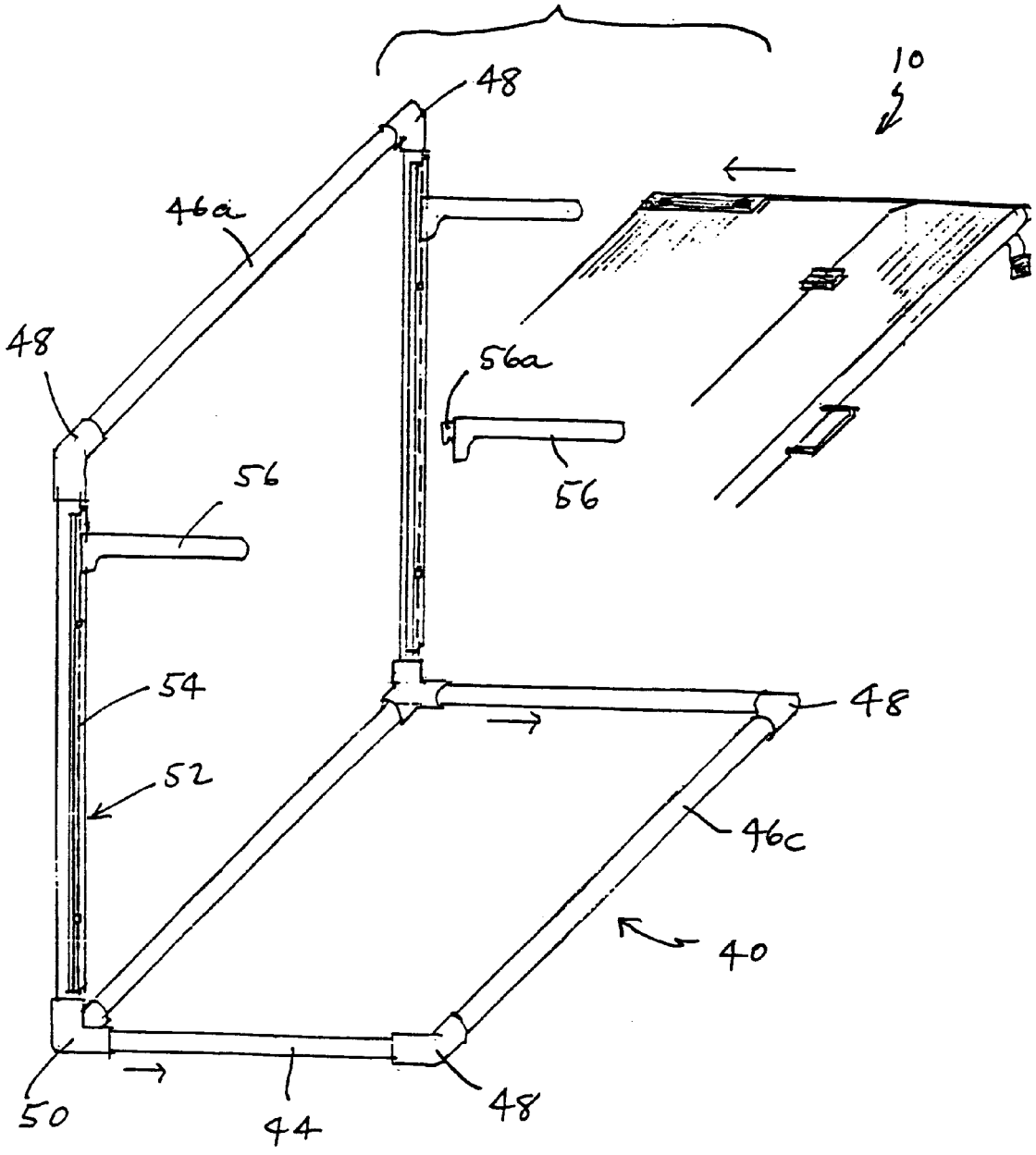
FIG. 11 is a perspective view of the storage rack which can be used to support one or more carrying cases of the type illustrated in FIGS. 1–10, showing of a carrying case being placed onto the stand for storage.

While the carrying case illustrated in FIGS. 1–10 facilitates the carrying of large flat articles, the remaining objects of the present invention can be achieved by utilizing a storage system which is generally designated by the reference 40 in FIG. 11. The storage system uses a support which includes at least two spaced substantially horizontal brackets 56 arranged in a common horizontal plane. The rear side 10*d* of the carrying case is provided with openings 26*a*, which are aligned with the frame members 14 configured to receive the brackets 56 to engage the frame members to thereby support the case 10 on the brackets.

It will be evident to those skilled in the art that different storage system designs can be developed suitable for use in connection with the carrying cases of the present invention. However, by way of example only, the support device or apparatus shown in FIG. 11 includes a pair of spaced vertical support members 42 and a base which consists of spaced base tubes 44 which are generally orthogonal or perpendicular to the vertical support members 42, so that when the base tubes 44 are placed on a horizontal surface, the support members 42 generally project upwardly in a vertical direction. Suitable horizontal bracing members 46*a*–46*c* are provided at the free ends of the respective vertical support members 42 and base tubes 44. When the various elongate support members and base tubes are formed of circular cross section PVC tubing, suitable "L" PVC elbows 48 may be used to connect the base tubes 44 to the bracing member 46*c* while similar PVC elbows may be used to connect the horizontal bracing member 46*a* to the vertical support members 42. Three-way elbows 50 may be used to connect the vertical support members 42, the base tubes 44 and the horizontal bracing member 46*b* to each other, as shown. Preferably, shelf runners 52 are mounted on the vertical support members 42. The shelf runners 52 are provided with conventional spaced slots 54 to provide adjustability in the positioning of shelf brackets 56 which are provided with hooks 56*a* dimensioned to be securely received within and engage the runners through the slots. Preferably, each pair of brackets 56 are positioned the same distance or height above the base tubes 44 to ensure that a carrying case placed on the respective brackets will remain substantially in a horizontal planes.

Figure 12:
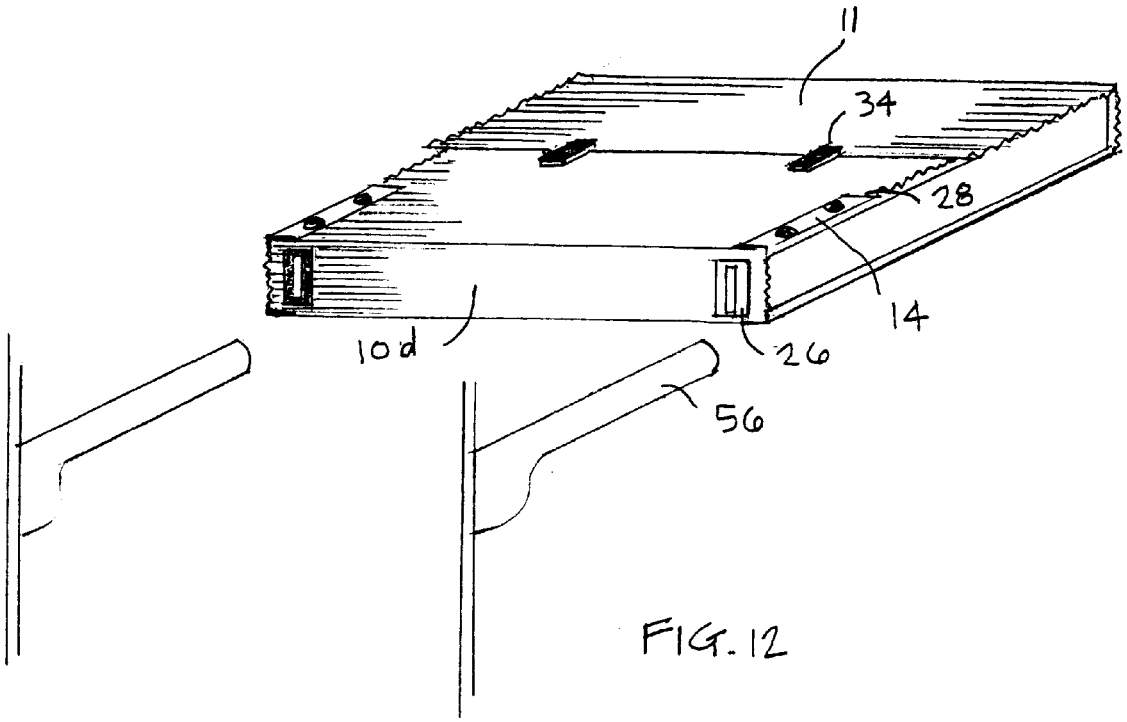
FIG. 12 is a perspective view of the supporting brackets of the storage unit shown in FIG. 11, as viewed from another angle, and illustrating the supporting brackets just prior to insertion into the slots within the cap plugs and the associated extrusions forming the frame members.
Figure 13:
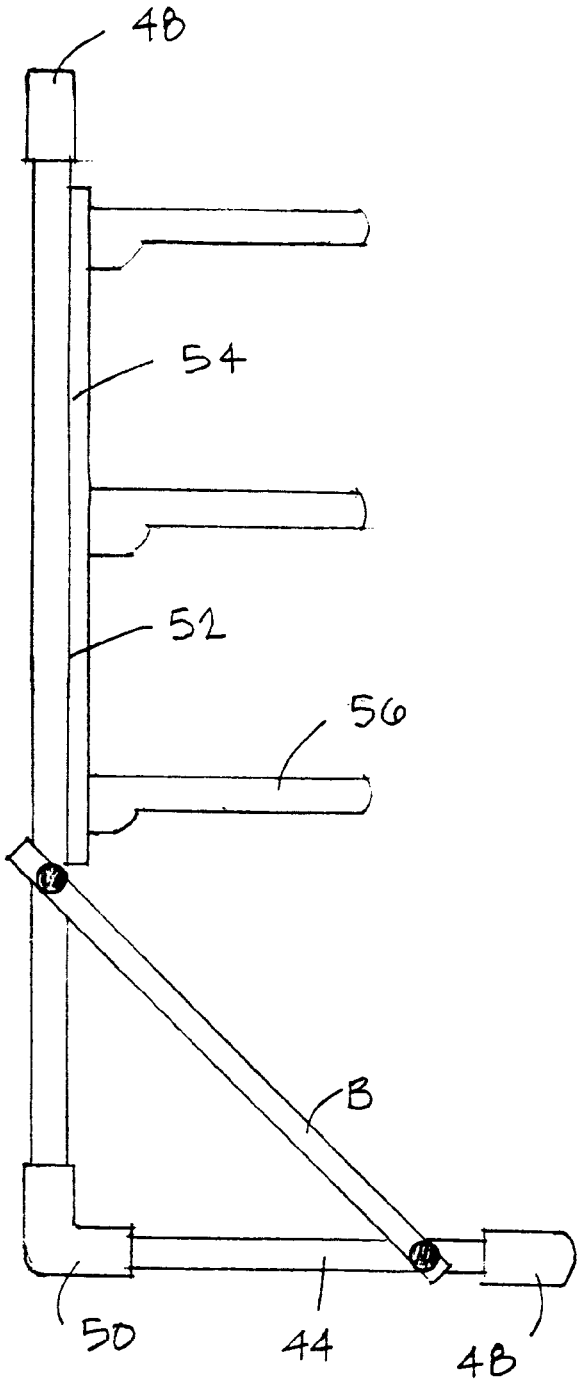
FIG. 13 is a side elevational view of the supporting rack shown in FIG. 11, showing a plurality of bracket sets for supporting a plurality of carrying cases, and also illustrating an additional brace for preventing relative movements between the base of the rack and the vertical support members.

While PVC tubes having circular cross sections have been illustrated, it will be clear that other storage device arrangements may be used while still achieving the objects of the invention. Thus, for example, the vertical support members 42 and base tubes 44 may be formed of rectangular cross section material. As suggested in FIG. 13, a plurality of brackets 56 may be used, suitably spaced from each other along the vertical direction to establish suitable spacing for the individual carrying cases 10 to be mounted and stored on the storage rack 40. In order to further strengthen or rigidify the support rack 40, a PVC pipe 60 or other bracing member may be used which is suitably secured to the vertical support members 42 and the base tubes 44, as shown in FIG. 13. As best shown in FIGS. 11 and 12, the carrying cases 10 can be easily and conveniently placed onto and supported on a pair of brackets by simply inserting those brackets through the openings 26*a* in the cap plugs 26. By placing a large number of spaced pairs of brackets, the resulting storage system is very effective for providing high density storage for large flat articles.

As suggested, by storing the flat articles within the carrying cases, such flat articles may be readily and quickly transported by removing the associated carrying case containing the flat articles from the support rack. After the carrying case has been used to transport the articles it may returned and again placed on the storage rack for indefinite storage.

Although the present invention has been described in relation to particular embodiments thereof many other variations, modifications and other uses will become apparent to those skilled in the art. It is the intention, therefore, that the present invention not be limited by the specific disclosure of the embodiments therein, but only by the scope of the appended claims.

What I claim is:

1. A storage system for storing at least one carrying case for flat articles comprising support means which includes at least two spaced substantially horizontal brackets supported in a common horizontal plane;

at least one flat carrying case having top and bottom, front and rear and lateral sides, said top and bottom sides having width dimensions, between said lateral sides, and depth dimensions, between said front and rear sides, which are substantially greater than the dimensions of said front, rear and lateral sides, between said top and bottom sides, at least said top and bottom sides being formed of a relatively thin, lightweight sheet material, a handle on at least one of the sides between the top and bottom sides for carrying the case; and at least two elongate substantially parallel rigid frame members arranged along said lateral sides of the case for stiffening the case and preventing twisting and warping of said top and bottom sides; and attachment means for selectively attaching said sheet material forming said top and bottom sides to said frame member to permit opening of the case and provide access to the interior thereof to insert or remove a flat article to or from the case;

said rear side of said at least one carrying case being provided with openings, aligned with said generally lateral frame members, configured to receive said brackets to engage said frame members to thereby support the case on said brackets.

2. A storage system for storing at least one carrying case for flat articles as defined in claim 1, further comprising cap plugs which are arranged at said openings and have openings corresponding to the shape of said brackets, said cap plugs projecting rearwardly of said rear wall to serve as feet pads for the case when freestanding on a support surface on said rear side.

3. A storage system for storing at least one carrying case for flat articles as defined in claim 1, wherein said support means comprises a pair of spaced substantially vertical support members; base means for maintaining said support members in the vertical direction, said brackets being mounted on said substantially vertical support members at substantially equal heights above said base means.

4. A storage system for storing at least one carrying case for flat articles as defined in claim 3, wherein a plurality of pairs of brackets are provided spaced from each other along said vertical support members, each pair of brackets being used to support another carrying case.

5. A storage system for storing at least one carrying case for flat articles as defined in claim 4, further comprising bracket support runners having means for supporting brackets at different positions along the lengths thereof, said support runners being mounted on said vertical support members, whereby the positions of said brackets may be adjusted to selected heights.

6. A storage system for storing at least one carrying case for flat articles as defined in claim 4, wherein said vertical support members are made of polyvinyl chloride (PVC) pipe.

7. A storage system for storing at least one carrying case for flat articles as defined in claim 6, wherein said base means comprises two sections of polyvinyl chloride pipe each connected to one of said vertical support members by means of a polyvinyl chloride elbow fitting or connector.

8. A storage system for storing at least one carrying case for flat articles as defined in claim 7, further comprising horizontal bracing members extending between and connected to said vertical support members to secure the latter and maintain the lateral spacing therebetween, whereby said brackets are maintained in positions for ready insertion into frame members of a carrying case to be supported.

9. Flat article carrying case having top and bottom, front and rear and lateral sides, said top and bottom sides having width dimensions, between said lateral sides, and depth dimensions, between said front and rear sides, which are substantially greater than the dimensions of said front, rear and lateral sides, between said top and bottom sides, at least said top and bottom sides being formed of a relatively thin, lightweight sheet material, a handle on at least one of the sides between the top and bottom sides, for carrying the case; and at least two elongate substantially parallel rigid frame members arranged along said, rear and lateral sides of the case for stiffening the case and reducing twisting and warping of said top and bottom sides; and attachment means for attaching at least a portion of said sheet material forming said top and bottom sides to said frame member to permit opening of the case and to provide access to an interior thereof to insert or remove a flat article to or from the case, said lightweight sheet material forming said top and bottom sides being substantially more flexible in the direction of said transverse sides than in the direction of said lateral sides, whereby said sheet material inherently provides the stiffness or rigidity to the case in said transverse direction while said frame members reinforce said sheet material along the direction parallel to said lateral sides, whereby the case exhibits requisite stiffness or rigidity against bending or flexing along any directions within the planes of said top and bottom sides, said attachment means permanently attaching said bottom side to said frame members and permanently attaching at least a portion of said top side to said frame members, remaining portions of said top side being attachable to or separable from said frame members by means of hook and loop fasteners on said top side portions and associated surfaces of said frame members.

10. Flat article carrying case as defined in claim 9, wherein said lightweight sheet material is formed of corrugated plastic sheet material.

11. Flat article carrying case as defined in claim 9, wherein said handle is provided on said front side of the case.

12. Flat article carrying case as defined in claim 9, wherein two frame said members are provided along said lateral sides of the case.

13. Flat article carrying case as defined in claim 9, wherein said lightweight sheet material forming said top and bottom sides is substantially more flexible in the direction of said transverse sides than in the direction of said lateral sides, whereby said sheet material inherently provides the stiffness or rigidity to the case in said transverse direction while said frame members reinforce said sheet material along the direction parallel to said lateral sides, whereby the case exhibits requisite stiffness or rigidity against bending or flexing along any directions within the planes of said top and bottom sides.

14. Flat article carrying case as defined in claim 13, wherein said top and bottom and front and rear sides are formed of a continuous length of said sheet of lightweight material.

15. Flat article carrying case as defined in claim 14, wherein said front side includes a portion of said sheet material which is arranged to overlap said top side; and further comprising clip means for securing said top side in the closed position thereof to prevent detachment of said top side portions from said frame members.

16. Flat article carrying case as defined in claim 9, wherein said frame members are formed of plastic tubing.

17. Flat article carrying case as defined in claim 16, wherein said tubing has a rectangular cross section.

18. Flat article carrying case having top and bottom, front and rear and lateral sides, said top and bottom sides having width dimensions, between said lateral sides, and depth dimensions, between said front and rear sides, which are substantially greater than the dimensions of said front, rear and lateral sides, between said top and bottom sides, at least said top and bottom sides being formed of a relatively thin, lightweight sheet material, a handle on at least one of the sides between the top and bottom sides for carrying the case; and at least two elongate substantially parallel rigid frame members arranged along at said rear and lateral sides of the case for stiffening the case and reducing twisting and warping of said top and bottom sides; and attachment means for attaching at least a portion of said sheet material forming said top and bottom sides to said frame member to permit opening of the case and to provide access to an interior thereof to insert or remove a flat article to or from the case, said two frame members being provided along said lateral sides of the case, and said rear side being provided with openings, generally aligned with said lateral frame members, configured to receive brackets that engage said frame members to support the case on the brackets.

* * * * *